United States Patent [19]

Hutchinson

[11] 4,051,567

[45] Oct. 4, 1977

[54] MATTRESS OR CUSHION SPRING ASSEMBLY

[75] Inventor: Ronald G. Hutchinson, Naperville, Ill.

[73] Assignee: Simmons Company, Atlanta, Ga.

[21] Appl. No.: 622,886

[22] Filed: Oct. 16, 1975

[51] Int. Cl.[2] ..... A47C 23/04

[52] U.S. Cl. ..... 5/260; 5/267

[58] Field of Search ..... 5/248, 256, 260, 261, 5/267, 268, 351; 297/452, 450, DIG. 8

[56] References Cited

U.S. PATENT DOCUMENTS

| | | | |
|---|---|---|---|
| 2,509,831 | 5/1950 | Martin | 5/261 |
| 3,255,470 | 6/1966 | Knittel et al. | 297/DIG. 8 |
| 3,590,404 | 7/1971 | Dreve, Jr. | 5/260 |
| 3,618,146 | 11/1971 | Ferdinand | 5/351 |

FOREIGN PATENT DOCUMENTS

| | | | |
|---|---|---|---|
| 189,486 | 11/1922 | United Kingdom | 5/248 |

*Primary Examiner*—Casmir A. Nunberg
*Attorney, Agent, or Firm*—Fitch, Even, Tabin & Luedeka

[57] ABSTRACT

A mattress or cushion spring assembly includes aligned rows of coil springs connected together within each row and between rows and additional reinforcing springs which are interspersed around the periphery of the spring assembly and are held in place by border helicals or other means.

5 Claims, 2 Drawing Figures

7
9
9a
11
11a
13
13a
15
17
19

9
9a
11
11a
15
17
19
21
23
23a

MATTRESS OR CUSHION SPRING ASSEMBLY

The invention relates to mattresses or cushions or the like, and particularly to edge reinforcement of such articles.

It is a familiar experience that mattresses and cushions are subjected in normal usage to intense local loading along their edges. Such loading tends in time to impair the appearance and comfort of the article. For example, sitting on the edge of a bed or the edge of a cushion in a chair tends to depress their respective borders, and the continued practice of such causes these articles to acquire a permanent set. The effect is particularly noticeable in public lodging facilities, for example, where a telephone is located at the side of the bed. The resulting set of the mattress is indicated by a depression or tilt, and the occupant of the bed tends to roll to this low area.

While peripheral reinforcements in the form of various special edge-reinforcing springs have been developed, it is an object of this invention to provide an improved edge-reinforcing means which is economical to manufacture, which is easy to install during construction stages of the article and which enhances the durability of the article.

Figure 1:
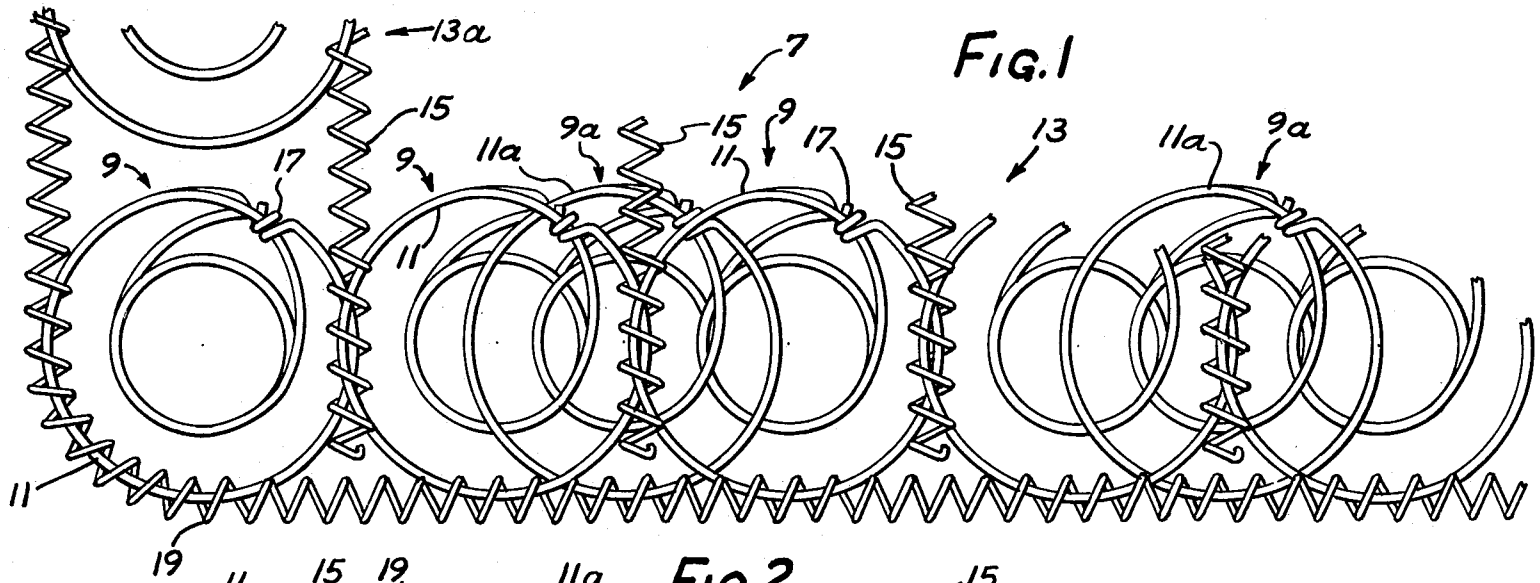
Figure 2:
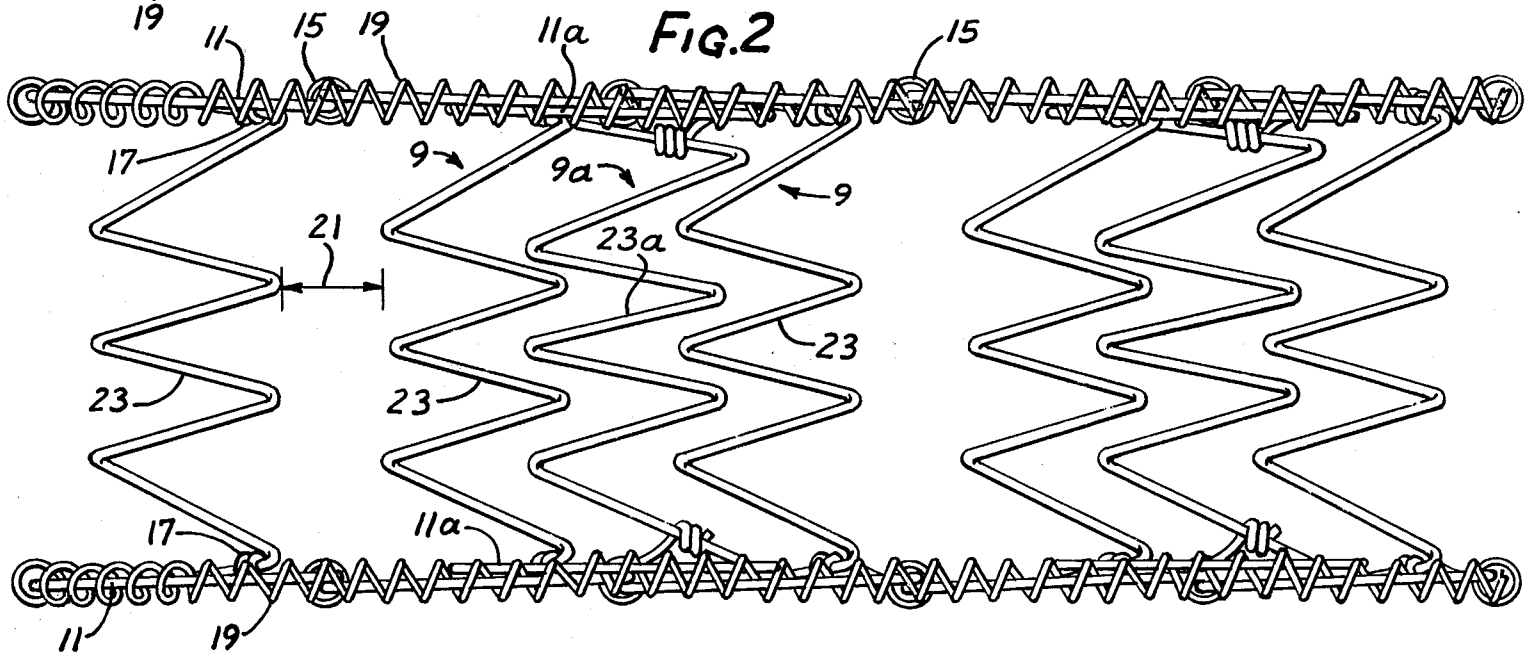

Other objects of the invention will become apparent and the invention readily understood from the following description read in connection with the accompanying drawing in which:

FIG. 1 is a partial diagrammatic plan view of a spring assembly embodying various features of the invention; and FIG. 2 is a partial elevational view of the assembly shown in FIG. 1.

Briefly, a mattress or cushion constructed in accordance with the invention is one which avoids the use of specially constructed edge supporting devices to reinforce the peripheral edges of the article. Rather, it interleaves conventional open coil springs as needed in the periphery of the assembly to accomplish the same result. The effect is to simplify the assembly, making it more economically constructed while also enhancing its durability.

Referring initially to FIG. 1 of the drawing, a partial view of an inner spring assembly 7 is shown for a mattress or cushion or the like. Inasmuch as the invention relates to the spring construction of the mattress, the outer envelope of upholstery is not shown, it being understood that any conventional finishing technique may be employed.

Referring now to FIGS. 1 and 2, the inner spring assembly 7 comprises a plurality of open wire coil springs 9, illustrated as double-cone or hour-glass in shape. The springs are assembled in rows, and a plurality of such rows are usually joined together row by row into a rectangular inner spring assembly in which the individual coils are aligned longitudinally and transversely of the assembly.

A typical machine made assembly, for example, might have 312 such coils, 24 rows of 13 coils each, or vice versa. The coils of adjacent transverse rows are in close proximity to each other so that their end convolutions 11 are juxtaposed or even slightly overlapped, as seen in a partial row indicated as 13 in FIG. 1. The adjacent rows are typically connected together by helical tie wires 15 which are threaded about the overlapping and juxtaposed portions of the end convolutions 11 of the springs. Each helical 15 ties adjacent coils together in a given row and simultaneously connects adjacent rows together.

Inter-row connections other than helical tie wires are also known, and the selection of the machine-assembled helical-tied construction for illustration should not be regarded as limiting the application of this invention.

A spring assembly 7 for mattresses is preferably made with the helical tie wires 15 extending from side-to-side of the mattress, i.e., transversely, so as to permit a degree of articulation of the spring construction in the long dimension of the mattress, thereby to provide the greater flexibility of the spring assembly in the direction along which the more drastic variations of the body weight of the occupant occur. In a cushion construction, these tie wires may extend from front to rear of the spring assembly to provide greater resistance to the shear loads to which cushions are subjected by the act of a person sitting in a chair. Although for the sake of clarity only the upper half of the construction is shown in the plan view in FIG. 1, it will be appreciated by reference to FIG. 2, that tying helicals 15 are used in both the top and bottom planes of the spring assembly, and that the orientation of the helicals is the same in both planes so that a mattress or a cushion embodying the construction will be reversible.

As best seen in FIG. 1, each wire coil spring 9 includes a knot 17 by means of which the extremities of the coil-forming wire used in each spring are attached to the next adjacent convolution of each spring. It will be noted that all of the individual coil springs 9 are so oriented about their own vertical axes that the knots 17 do not interfere with the helical tie wires 15 which connect adjacent springs together, nor with the wires 19, as later described, that assist in making up the borders of the spring assembly 7.

As mentioned previously, varying forms of edge-reinforcing or periphery reinforcing devices or border stiffeners, frequently referred to as edge springs or supports in the trade, have been developed. These varying forms, however, have required specially designed springs or other special components that are in addition to the conventional components already described herein. It has been found, however, that a practical and economical solution to the problem of providing edge-reinforcement in mattresses or cushions has been heretofore overlooked, i.e., interleaving the open coil springs in at least selected areas or zones of the periphery to thereby increase the resistance of the mattress or cushion edge to compression.

After a mattress inner spring assembly has been preassembled in the form just described, a space 21 exists between the inner convolutions 23 of the lineally adjacent double-cone springs 9 even though their respective end convolutions 11 are juxtaposed or slightly overlap each other. To reinforce the side edges of such a spring assembly, an additional double-cone spring 9*a* which may have the same height and construction as the springs 9 is inserted in between selected pairs of adjacent peripheral springs. Both the top and bottom end convolutions 11*a* of the spring 9*a* engage the respective end convolutions 11 of the adjacent springs 9 on the insides thereof and thus provide a supporting engagement in respect of these adjacent springs. The specific number of these added springs along the sides of the mattress may be determined according to need. In like manner, the mattress edges at both the head and the foot of the mattress may be reinforced, thus providing reinforcement for the entire mattress periphery as required.

One specific example of a mattress construction utilizing these added springs for edge reinforcement has been built which included 312 coil springs 9 in a pattern of 13 rows wide and 24 rows long. Eight additional coil springs 9a were interspersed in substantially equal spacing along both sides of the mattress. Thus, substantially every third space between the ends of the lateral or short rows had a coil spring 9a inserted therein. Although this is an example of one specific construction, it should be understood that an inner spring construction for a mattress in accordance with this invention could include fewer additional coil springs 9a along each side, or could be expanded to fill all the spaces so as to constitute a peripheral row of continuously interleaved springs. Substantially the same principles apply to cushions or the like, although the primary need for edge-reinforcement in cushions typically is the front rather than the side edges.

Once the coil springs 9a are inserted in their selected locations, top and bottom border wires 19 are added to hold the inserted springs 9a in place and to provide the finishing step of the inner spring assembly 7 construction. Although these border wires 19 may be in any known form, the illustrated helical border wires 19 are threaded about points of tangency therewith of the outer portions of the top and bottom end convolutions 11 and 11a of all of the springs that form the periphery of the inner spring assembly 7. Thus, the coil springs 9a are held in place along with the adjacent coil springs 9 by the top and bottom border wires 19, the reinforcing characteristic of the coil springs 9a being in the vertical direction as their end convolutions 11a are in supporting engagement with the end convolutions 11, as well as connected thereto by the common border wire.

It will be seen from the foregoing description that this form of edge-reinforcing means, utilizing additional springs which may conventionally be of the very same construction as those forming the core assembly, provides an extremely simple mattress inner spring construction to fabricate and to assemble. The economics of this improved edge-reinforcing means is also apparent from the foregoing description.

While the invention has been described in connection with a preferred embodiment, alternatives, modifications, and variations may be apparent to those skilled in the art in view of the foregoing description. Accordingly, it is intended to embrace all such alternatives, modifications, and variations as fall within the spirit and scope of the appended claims.

What is claimed is:

1. A spring assembly for a mattress or cushion or the like having at least a peripheral row of vertical open-coil helical wire springs and top and bottom border wires to which said springs are connected, said springs in at least selected zones of only said peripheral row along each side of said assembly being interleaved with their top and bottom convolutions in overlapping engagement to reinforce the side edges of the assembly.

2. A spring assembly in accordance with claim 1 comprising aligned rows of vertical, open coil helical wire springs connected together within each row and between rows and wherein the interleaving of springs in said peripheral row of springs is accomplished by the insertion of additional springs of the same height and construction as those of said rows in the spaces between selected adjacent peripheral springs thereof with the end convolutions of said additional springs engaging the inside of the top and bottom end convolutions of said selected adjacent springs in supporting engagement therewith.

3. A spring assembly in accordance with claim 2 wherein said top and bottom border wires are in the form of helical tie wires threaded about points of tangency therewith of the outer portions of the end convolutions of the springs forming the periphery of said assembly, including said additional springs.

4. A rectangular spring assembly for a mattress or cushion or the like comprising aligned transverse rows of vertical, open coil helical wire springs connected together within each row and between rows by transverse helical tie wires threaded about the juxtaposed portions of the top and bottom end convolutions of the springs of adjacent rows; top and bottom border wires connected to the peripheral springs of the assembly; and additional springs of the same height and construction as those of said rows inserted along the longitudinal side edges of the assembly into the spaces between adjacent springs along the longitudinal edges of the assembly with the end convolutions of said additional springs engaging the insides of the top and bottom end convolutions of said connected edge springs in supporting engagement therewith, being crossed diametrically by said transverse tie wires, and connected to said top and bottom border wires respectively to secure said additional springs in said inserted position.

5. The assembly of claim 4 wherein said border wires are also helical tie wires threaded about the top and bottom convolutions of said end springs and additional springs alike.

* * * * *